United States Patent [19]

Reifenberg

[11] 4,355,514

[45] Oct. 26, 1982

[54] CONTROL DEVICE FOR STEAM TURBINES WITH REHEATER

[75] Inventor: Rolf Reifenberg, Mülheim, Fed. Rep. of Germany

[73] Assignee: Kraftwerk Union Aktiengesellschaft, Mülheim, Fed. Rep. of Germany

[21] Appl. No.: 191,843

[22] Filed: Sep. 29, 1980

[30] Foreign Application Priority Data

Sep. 28, 1979 [DE] Fed. Rep. of Germany ..... 2939534

[51] Int. Cl.[3] ..... F01K 13/02

[52] U.S. Cl. ..... 60/660; 60/657

[58] Field of Search ..... 60/646, 657, 660, 653, 60/679

[56] References Cited

U.S. PATENT DOCUMENTS 3,561,216 2/1971 Moore, Jr. ..... 60/646 X
3,913,329 10/1975 Priluck ..... 60/660
3,928,972 12/1975 Osborne ..... 60/646

FOREIGN PATENT DOCUMENTS 1042613 9/1966 United Kingdom .

*Primary Examiner*—Allen M. Ostrager
*Assistant Examiner*—Stephen F. Husar
*Attorney, Agent, or Firm*—Herbert L. Lerner; Laurence A. Greenberg

[57] ABSTRACT

Control device for a steam turbine having a high-pressure and a medium or low-pressure turbine part, includes a reheater, at least one live steam control valve disposed upstream of the high-pressure turbine part, at least one intercept control valve disposed upstream of the medium or low-pressure turbine part and downstream of the reheater, a control device having at least one turbine controller for simultaneously acting on the live steam control valve in accordance with a predetermined live steam valve characteristic and acting on the intercept control valve in accordance with a predetermined intercept valve characteristic, the live steam control valve and the intercept control valve having a normal characteristic correlation therebetween determining a correlation of high-pressure and medium or low-pressure steam mass flow, a limit detecting device associated with the high-pressure turbine part for responding when a predetermined thermal stress is reached in the high-pressure turbine part, and a positioning device controlled by the limit detecting device for changing the normal characteristic correlation and increasing the high-pressure steam mass flow in the steam mass flow correlation.

15 Claims, 3 Drawing Figures

CONTROL DEVICE FOR STEAM TURBINES WITH REHEATER

Figure 1:
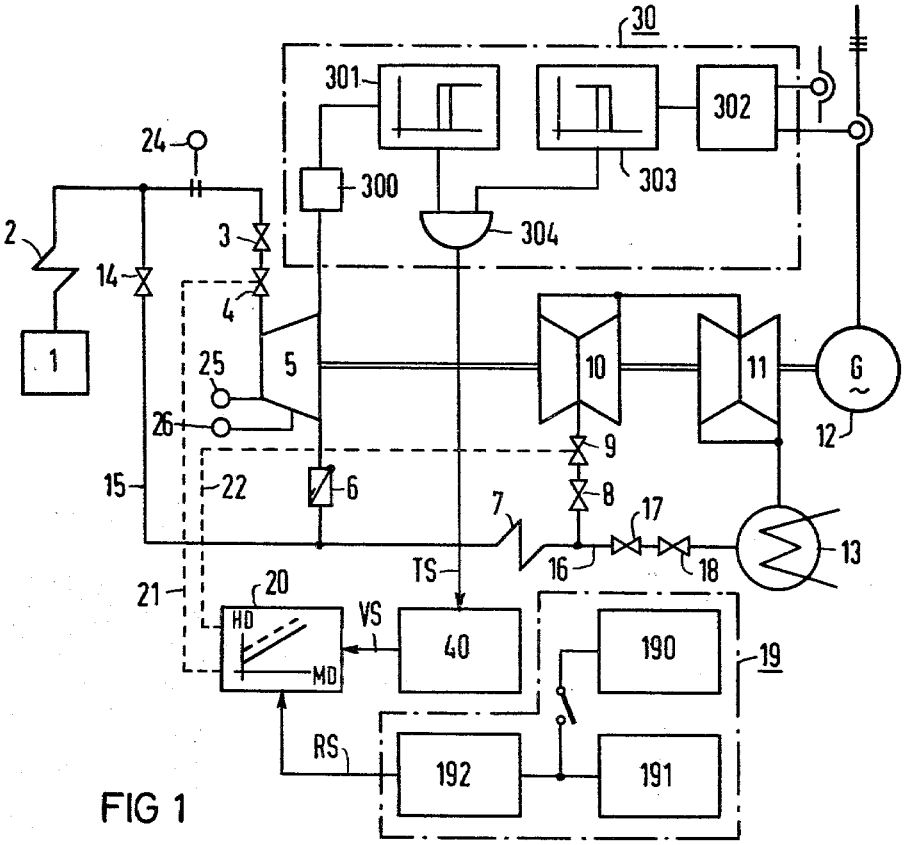

The invention relates to a control device for a steam turbine working with a reheater, with at least one live steam control valve ahead or upstream of the high-pressure turbine part and at least one intercept control valve ahead or upstream of the medium-pressure or low-pressure turbine part following the reheater, in which a turbine control with at least one turbine regulator acts simultaneously, in accordance with a predetermined live steam valve characteristic, on the live steam control valve and, according to a predetermined intercept valve characteristic, on the intercept control valve.

Such a control device is known from British Pat. No. 1,042,63. Due to the reheating of the steam leaving the high-pressure turbine part, the control device must meet special requirements. The steam content of the reheater bundles and the following piping is so large, that in the event of load shedding, the expansion of this steam could drive the speed of the load-relieved steam turbine up, even if the live steam control valves are completely shut off. In order to limit the increase of the speed in the case of load shedding, and to prevent the fast shut-down device from being tripped, the intercept control valves are therefore disposed after or downstream of the reheater directly before the steam reenters the turbine. The turbine control acts on the live steam control valves and the intercept control valves, and is to position them so that a given relationship between the high-pressure steam mass flow to the medium-pressure or low-pressure steam mass flow results and the storage effect of the reheater is eliminated. To prevent additional throttling losses, the intercept valves, however, are fully opened in the upper load range. Since the control-dependent controls of the intercept control valves must therefore proceed in accordance with a different physical law than the live steam valves, the correlation of the valve strokes and the steam mass flows is given by a live steam valve characteristic and an intercept valve characteristic.

In the hereinafore-described steam turbines with a reheater, particularly in those with throttle control, relatively high exhaust steam temperatures are obtained at the exit of the high pressure turbine part, if after higher loads, a sudden transition occurs due to load shedding to very low powers or idling and the counter-pressure of the high-pressure turbine part remains high, at least temporarily. The latter condition is due to the high boiler output which is still present after load shedding, and which normally cannot be arbitrarily quickly reduced.

Due to the hereinafore-described higher exhaust steam temperatures, substantially higher thermal stresses occur in the exit region of the high-pressure turbine part than in the normal operating conditions. It is therefore economical to limit the thermal stress of the high pressure turbine part. For this purpose, the correlation of the high-pressure steam mass flow to the medium-pressure or low-pressure flow has been calculated for this purpose in the past in such a way that a thermal stress with a limit temperature of the exhaust steam of, for instance, 500° C. is not exceeded. In some steam turbine installations, however, this temperature limit can be maintained only if the high-pressure steam mass flow is increased at the expense of the medium or low-pressure steam mass flow. The latter, however leads to insufficient cooling of the turbine parts following the reheater and therefore, in some circumstances, to undue thermal stresses of these turbine parts.

It is accordingly an object of the invention to provide a control device for steam turbines operating with a reheater which overcomes the hereinafore-mentioned disadvantages of the heretofore-known devices of this general type, and to do so in such a manner that, with sufficient cooling of the turbine parts following the reheater, the thermal stress in the exit region of the high-pressure turbine part is limited.

With the foregoing and other objects in view, there is provided, in accordance with the invention a control device for a steam turbine having a high-pressure and a medium or low-pressure turbine part, comprising a reheater, at least one live steam control valve disposed upstream of the high-pressure turbine part, at least one intercept control valve disposed upstream of the medium or low-pressure turbine part and downstream of the reheater, control means having at least one turbine controller for simultaneously acting on the live steam control valve in accordance with a predetermined live steam valve characteristic and acting on the intercept control valve in accordance with a predetermined intercept valve characteristic, the live steam control valve and the intercept control valve having a normal characteristic correlation therebetween determining a correlation of high-pressure and medium or low-pressure steam mass flow, limit detecting means associated with the high-pressure turbine part for responding when a predetermined thermal stress is reached in the high-pressure turbine part, and positioning means controlled by the limit detecting means for changing the normal characteristic correlation and increasing the high-pressure steam mass flow in the steam mass flow correlation. In the control device according to the invention, the predetermined correlation of the high-pressure steam mass flow and the medium or low-pressure steam mass flow is therefore maintained even under normal operating conditions. The limit-detecting device responds and causes an increase of the high-pressure steam mass flow through the positioning device, without the medium-pressure or the low-pressure cooling steam quantity becoming too small only if, for instance, a predetermined thermal stress is reached after sudden load shedding. The flow through the high-pressure turbine part, which becomes greater under the conditions named hereinabove, therefore leads to an effective limitation of the thermal stress in the exit region. The positioning device can cause the increase of the high-pressure steam mass flow by a parallel shift of the live steam valve characteristics and/or of the intercept valve characteristic, since a reduction of the medium-pressure or low-pressure steam mass flow through the intervention of the turbine control, which takes place to keep the power constant, also leads to an increase of the high-pressure steam mass flow. The operation of the control device according to the invention can therefore also be represented as a temporary shift of the power shares of the high-pressure part on the one hand, and the medium-pressure or low-pressure turbine part, on the other hand.

The control device according to the invention can also be used for two or more turbo units connected to one steam generator. Besides the requirements in the event of sudden load shedding, there also exists herein the need of an effective limitation of the thermal stress of the high-pressure turbine part when a turbine set is started, if another turbo set is already loaded and therefore generates a high pressure in the common counter-pressure network.

In accordance with another feature of the invention, the limit detecting means includes sensing means for measuring temperature of exhaust steam in vicinity of the outlet of the high-pressure turbine part, and limit signal transmitting means connected to the sensing means for responding when a predetermined temperature limit is exceeded. Such a limit-detecting device is of particularly simple construction. On the other hand, the delays due to sluggishness of the temperature measuring sensor must be tolerated in determining the temperature.

In accordance with a further feature of the invention, the thermal stress can be determined substantially faster if the limit detecting means includes first measuring means for determining counter pressure of the high-pressure turbine part, first limit signal transmitting means connected to the first measuring means for issuing an output signal if a predetermined pressure limit is exceeded, second measuring means for determining at least one of the power of the turbine and an operating variable corresponding to the quantity of high-pressure steam, second limit signal transmitting means connected to the second measuring means for issuing an output signal if at least one of the turbine power and the measured operating variable falls below a predetermined value, and an AND gate having inputs for receiving the output signals. In such an embodiment of the limit-detecting device, operating variables are therefore determined which lead to a high thermal stress if certain limits are not simultaneously maintained.

In accordance with an added feature of the invention, the first measuring means and the first limit signal transmitting means are combined in the form of a pressure monitor.

In accordance with an additional feature of the invention, to increase the reliability of the counter-pressure measurement, there is provided another pressure monitor independent of the first-mentioned pressure monitor, and an OR gate having an input connected to each of the pressure monitors and an output connected to one of the inputs of the AND gate.

In accordance with yet another feature of the invention, there is provided a generator driven by the turbine, the second measuring means being in the form of means for measuring electric active power of the generator.

In accordance with yet a further feature of the invention, the second measuring means is in the form of means for measuring the quantity of live steam.

In accordance with yet an added feature of the invention, the second measuring means is in the form of means for determining the wheel space pressure of the high-pressure turbine part.

In accordance with yet an additional feature of the invention, the high-pressure turbine part has drum blades, and the second measuring means is in the form of means for determining the pressure upstream of the drum blades of the high-pressure turbine part.

In accordance with again another feature of the invention, the second measuring means is in the form of means for determining the stage pressure of a stage of the high-pressure turbine part.

In accordance with again an added feature of the invention, the positioning means changes the normal characteristic correlation by parallel displacement of the intercept valve characteristic. Such a shift can be brought about without difficulty, since only a part of the total control stroke generated by the turbine control is utilized for the intercept control valves. In contrast thereto, the mechanical limits of the turbine control would have to be taken into consideration for a parallel shift of the live steam valve characteristic.

In accordance with again an additional feature of the invention, there is provided at least one first servo piston having a pretensioned spring through which the control means acts on the live steam control valve, and at least one second servo piston having a pretensioned spring through which the control means acts on the intercept control valve, the positioning means including means for increasing the pretension of the spring of the first servo piston relative to the pretension of the spring of the second servo piston. Therefore the positioning device increases the pretension of the tension spring of the servo piston associated with the live steam control valve and/or reduces the pretension of the tension spring of the servo piston associated with the intercept control valve. The desired change of the normal correlation of the valve characteristics can be brought about in a particularly simple manner in this way. For the reasons already mentioned, it is particularly advantageous in view of the mechanical limits of the turbine control, if in accordance with still another feature of the invention the positioning means changes the normal characteristic correlation by parallel displacement of the intercept valve characteristic and the relative pretension increasing means exclusively reduces the pretension of the spring of the second servo piston.

In accordance with yet a further feature of the invention, the relative pretension increasing means includes a hydraulic power piston for changing the pretension of the tension spring of the second servo piston.

In accordance with a concomitant feature of the invention, there is provided a magnetic valve controlling the hydraulic power piston.

Other features which are considered as characteristic for the invention are set forth in the appended claims.

Although the invention is illustrated and described herein as embodied in control device for steam turbines with reheater, it is nevertheless not intended to be limited to the details shown, since various modifications and structural changes may be made therein without departing from the spirit of the invention and within the scope and range of equivalents of the claims.

Figure 2:
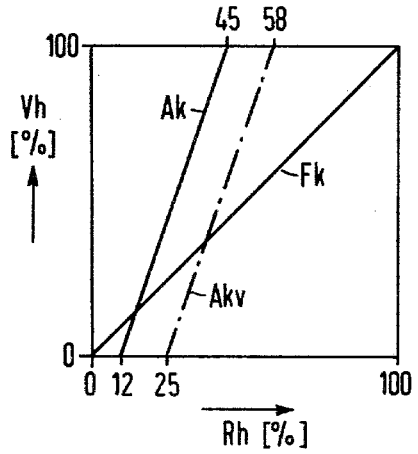
Figure 3:
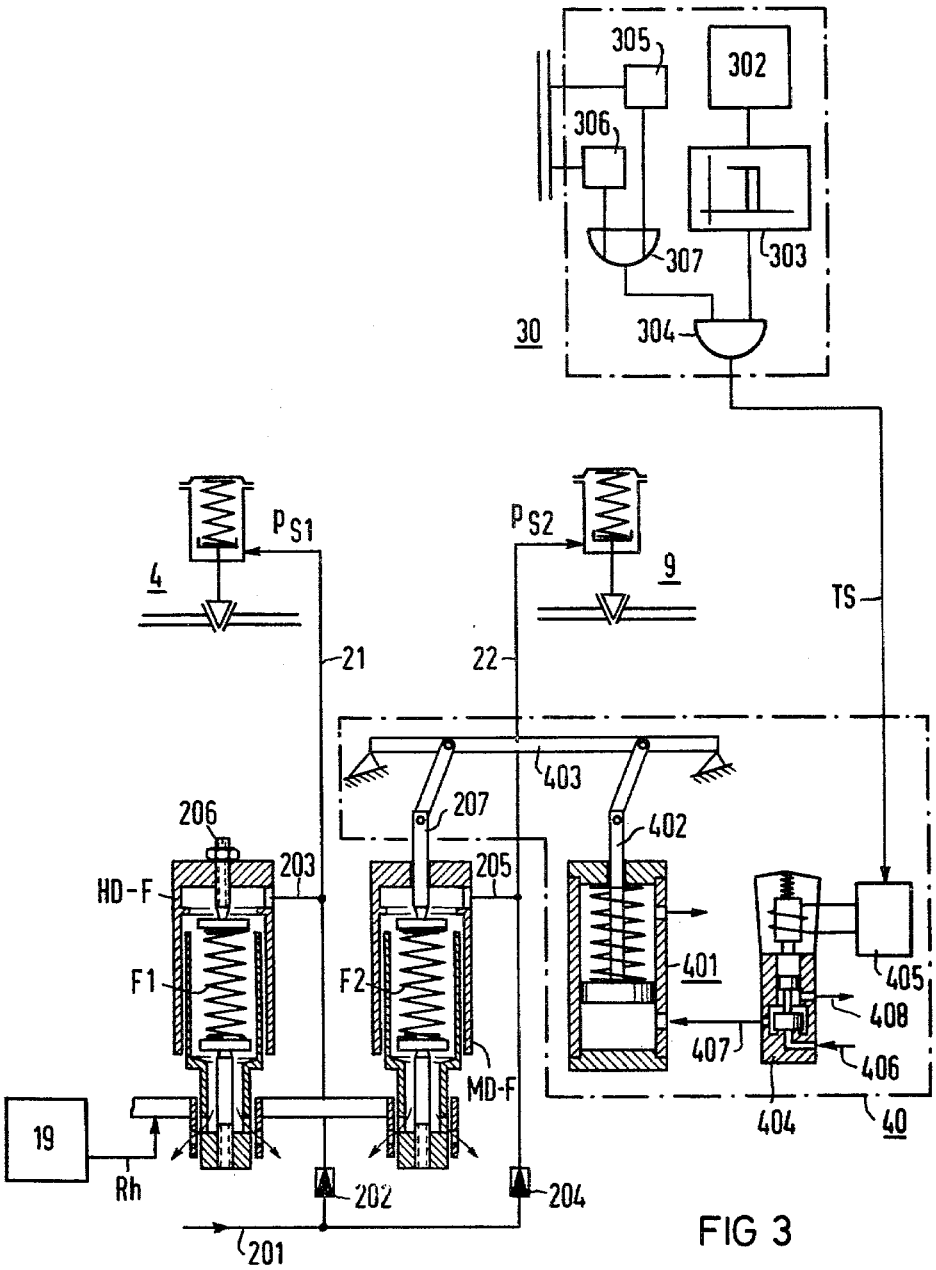

The construction and method of operation of the invention, however, together with additional objects and advantages thereof will be best understood from the following description of specific embodiments when read in connection with the accompanying drawings, in which:

FIG. 1 is a simplified shcematic block diagram of a control device for a steam turbine with a reheater, and an embodiment example of the limit-detecting device;

FIG. 2 is a graphical representation of normal and changed coordination of the live steam valve characteristic and the intercept valve characteristic of the control device shown in FIG. 1; and FIG. 3 is a diagrammatic cross-sectional and schematic block diagram view of an embodiment example of the positioning device of the control device shown in FIG. 1, in conjunction with a variant of the limit-detecting device.

Referring now to the figures of the drawing and first, particularly, to FIG. 1 thereof, it is seen that the steam flows from a steam generator 1 followed by a superheater 2 through a high-pressure fast shut-down valve 3 and a live steam control valve 4 into a high-pressure turbine part 5. The steam leaving the high-pressure turbine part 5 then flows through a check valve 6, a reheater 7, an intercept fast acting shut off valve 8 and an intercept control valve 9 into a medium-pressure turbine part 10. From there, the steam then flows through a low-pressure part 11, which together with the medium-pressure turbine part 10 and the high-pressure turbine part 5 drives a generator 12, and into a condenser 13. The steam can also be fed, from the superheater 2, bypassing the high-pressure turbine part 5, through an overflow part 14 and a high-pressure bypass line 15, directly to the reheater 7. There is furthermore provided a relief line 16 with a fast-acting dump valve 17 and a relief control valve 18 between the reheater 7 and the condenser 13 for bypassing the medium-pressure turbine part 10 and the low-pressure turbine part 11. The minimum amount of steam produced when the steam generator 1 is started is taken to the condenser 13 through the high-pressure by-pass line 15 and the overflow valve 14 directly to the reheater, and from there through the relief line 16, the fast-acting dump valve 17 and the relief control valve 18 into the condenser 13, as long as the turbine cannot absorb this amount of steam.

The speed and the power of the steam turbine installation are controlled by an electro-hydraulic turbine control 19. This turbine control 19 substantially includes a power controller 190 and a speed controller 191, the signals of which are fed to an opening control 192. The respectively leading control 190 or 191 acts through the opening control 192 and an electro-hydraulic converter 20 and simultaneously acts through a signal line 21, shown in dotted lines, on the live steam control valve 4, and through a signal line 22, also shown in dotted lines, on the intercept control valve 9. The signal RS generated by the turbine control 19 are transformed in the electro-hydraulic converter 20 for addressing the live steam control valve 4 in accordance with a different principle or natural law than for addressing the intercept control valve 9. In this connection, reference is made to the diagram of FIG. 2, in which the control-dependent regulation of the live steam control valve 4 by the live steam valve characteristic Fk and the control-dependent regulation of the intercept control valve 9 by the intercept valve characteristic Ak are shown. The valve stroke Vh of the respective valve is plotted in FIG. 2 against a control stroke Rh generated by the turbine control 19. In the example shown, the live steam control valve 4 opens uniformly over the entire range of the control stroke Rh utilized, while the intercept control valve 9 begins to open at about 12% of the control stroke Rh and is fully open at about 45% of the control stroke Rh. Through such setting and coordination of the live steam valve characteristic Fk and the intercept valve characteristic Ak, it is ensured that, on the one hand, for instance in the case of load shedding, the steam quantity enclosed in the reheater 7 which cannot be influenced by the live steam control valve 4, is managed by the intercept control valve 9.

It is further ensured that, on the other hand, in the upper load range, the intercept control valve 9 is fully open to prevent additional throttling losses.

If, after higher loads there is a sudden transition to very small loads or no load, the counter-pressure of the high-pressure turbine part 5 remains at least temporarily high due to the still present high boiler output and the exhaust steam temperature in the exit region of the high pressure turbine part 5 rise steeply. This leads under some conditions to an undesirable or impermissible thermal stress of the high pressure turbine part 5.

For limiting the thermal stress described hereinafore, the control device additionally includes a limit-detecting device 30 and a positioning device 40. The limit-detecting device 30 serves the purpose of determining the thermal stress in the exit region of the high-pressure turbine part 5 and of indicating that a predetermined limit of the thermal stress has been reached through a signal TS. The limit of the thermal stress can be set, for instance, in such a manner that the signal TS is made available at high-pressure exhaust steam temperatures of about 500° C. The signal TS is fed to the positioning device 40. As long as the signal TS is present, the device 40 changes the normal correlation of the high-pressure steam mass flow to the medium-pressure steam mass flow in the direction of increasing the high-pressure steam mass flow through a positioning signal VS. In the block diagram of the electro-hydraulic converter 20, the normal correlation of the high-pressure steam mass flow designated with reference character HD to the medium-pressure steam mass flow designated with reference character MD is indicated by a solid line, and the changed correlation is indicated by a dotted line. The positioning device 40 therefore causes heavier flow through the high-pressure turbine part 5 and accordingly a reduction of the thermal stress. Since the high-pressure steam mass flow is determined by the live steam control valve 4 and the medium-pressure steam mass flow is determined by the intercept control valve 9, the normal coordination of the two steam mass flows is determined by the predetermined normal correlation of the live steam valve characteristic Fk to the intercept valve characteristic Ak. The desired change in the correlation of the two steam mass flows is therefore brought about by a change of the correlation of the valve characteristics Fk and Ak. This can be done, for instance, as shown in FIG. 2, by a parallel shift of the intercept valve characteristic Ak into the changed position Akv shown by the dot-dash lines. This lowering of the characteristic directly causes a reduction of the medium-pressure steam mass flow and through the subsequent intervention of the turbine control 19, it indirectly causes an increase of the high-pressure steam mass flow. The absolute amount by which the intercept valve characteristic Ak is shifted, plays a secondary role here as long as the thermal stress of the high-pressure part 5 is kept within the desired limits by the increase of the high-pressure steam mass flow which is achieved. In the case shown, the intercept valve characteristic Ak is shifted into the position by Akv by an amount which corresponds to 13% of the control stroke Rh.

A block diagram of an embodiment example of the limit-detecting device 30 is also illustrated in FIG. 1. For determining the thermal stress of the high-pressure turbine part 5 there are provided, in detail, a pressure or temperature measuring device 300 followed by a limit signal transmitter 301, and a power measuring device 302 followed by a limit signal transmitter 303 which transmits a signal to one input of an AND gate 304 corresponding to the load of the generator 12. The pressure or temperature measuring device 300 measures the counter-pressure or temperature of the high-pressure turbine part 5 and delivers a signal corresponding to the measured pressure or temperature to the limit signal transmitter 301. The response value of the limit signal transmitter 301 is set so that at very small powers, for instance at powers less than 10% of nominal power, a signal is delivered to the other input of the AND gate. Only if both signals are present simultaneously at the inputs of the AND gate 304, i.e. if the counter-pressure is too large as compared to the minimum load run, and a danger of excessive thermal stress exists due to the insufficient gradient in the high-pressure turbine part 5, does the signal TS appear at the output of the AND gate.

As an alternative to the power measurement by the power measuring device 302, operating variables corresponding to the high-pressure steam quantity can also be determined. Some of these alternatives are indicated in FIG. 1 by a device 24 for measuring the quantity of the live steam, a device 25 for determining the wheel space pressure of the high-pressure turbine part 5, and a device 26 for determining the stage pressure of a stage of the high-pressure turbine part 5.

In FIG. 3, an embodiment example of the positioning device 40 and a variant of the limit-detecting device 30 are shown. In this variant of the limit-detecting device 30, pressure monitors 305 and 306 are connected to the high-pressure exhaust steam line 2, which is not designated in detail; the output signals of the pressure monitors are fed to the two inputs of an OR gate 307. It is ensured thereby that even in the event of a failure of one of the two pressure monitors 305 and 306, a signal is passed on from the output of the OR gate 307 to the associated input of the AND gate 304, if a high counter pressure is present.

For a better understanding of the function for the positioning device 40, reference is first made to the turbine control 19 shown as a block, which generates the control stroke indicated by the arrow designated with reference character Rh. This control stroke Rh is converted, using so-called servo pistons, into oil pressure changes and specifically by a servo piston HD-F into a secondary oil pressure $p_{s1}$, and by a servo piston MD-F into a secondary oil pressure $p_{s2}$. The servo device of the live steam control valve 4 is controlled by the secondary oil pressure $p_{s1}$ and the servo device of the intercept control valve 9 is controlled by the secondary oil pressure $p_{s2}$. For controlling the relief control valve 18 (shown in FIG. 2), a further non-illustrated servo piston can be used. The secondary oil pressure $p_{s1}$ comes about by the fact that from a line 201 connected with the fast shutdown oil loop pressure, oil is fed through a choke 202 to the signal line 21 leading to the live steam control valve 4, where the servo piston HD-F connected to the signal line 21 by a line section 203 releases a run-off cross section for this pressure oil. This run-off cross section brings about equilibrium between the tension of the tension spring F1 of the servo piston HD-F and the secondary oil pressure $p_{s1}$ as a function of the control stroke Rh. Similarly, the secondary oil pressure $p_{s2}$ comes about by the fact that from the line 201 pressure oil is fed through a choke 204 to the signal line 22 leading to the intercept control valve 9, where the servo piston MD-F, which is connected by a line section 205 to the signal line 22, releases a run-off section for this pressure oil. This run-off cross section leads to an equilibrium between the tension of the tension spring F2 of the servo piston MD-F and the secondary oil pressure $p_{s2}$, as a function of a control stroke Rh.

It is seen from the hereinafore-described operation of the servo piston HD-F and MD-F that the shape of the live steam valve characteristic Fk and the intercept valve characteristic Ak (shown in FIG. 2) is determined by the spring chracteristic and the chosen pretension of the tension spring F1 and the tension spring F2, respectively. The setting of the pretension of the tension spring F1 can be varied in the case of the servo piston HD-F by a setscrew 206 for fine setting of the control. In the case of the servo piston MD-F, a movable positioning pin 207 is provided in lieu of a setscrew, which makes it possible to change pretension of the tension spring F2 and thereby performs a parallel shift of the intercept valve characteristic Ak (shown in FIG. 2) with the positioning device 40. For fine adjustment, an adjusting device, which is not shown in detail in the drawing, is also provided here, for instance in the form of a threaded sleeve screwed on the positioning pin 207. The positioning device 40 has a hydraulic power piston 401 for changing the spring pretension. The piston rod 402 of the piston 40 is connected by a linkage 403 to the positioning pin 207 of the servo piston MD-F. The hydraulic power piston 401 is controlled by a magnetic valve 404 and a relay 405. In the normal position, oil under pressure indicated by an arrow 406 is conducted through the magnetic valve 404, as indicated by the arrow 407, below the piston surface of the power piston 401, so that the piston rod 402 occupies an upper position. Accordingly, the positioning pin 207 of the servo piston MD-F also occupies an upper position which corresponds to a normal pretension of the tension spring F2 and the shape of the intercept valve characteristic Ak in FIG. 4. If a signal TS is now given to the relay 405 by the limit-detecting device 30, then the run-off, indicated by the arrow 408, of the magnetic valve 404 for the pressure oil 406 is opened and the hydraulic power piston 401 is relieved. The piston rod 402 is therefore brought into the lower position shown in the drawing by the force of a spring of the hydraulic power piston 401 which is not specifically designated. Accordingly, the positioning pin 207 of the servo piston MD-F also occupies a lower position shown in the drawing, which corresponds to a reduced pretension of the tension spring F2 and the shape of the displaced intercept valve characteristic Akv in FIG. 2.

The hereinafore-described positioning device changes the correlation of the high-pressure steam mass flow to the medium-pressure steam mass flow only if the danger of an excessive thermal stress is indicated by the limit detecting device. This is the case if after sudden load shedding, the live steam control valves and the intercept control valves are also closed. Seen timewise, the positioning device thus intervenes as a rule between the load shedding and the reopening of the valves for leveling to the residual power or idling.

There are claimed:

1. Control device for a steam turbine having a high-pressure and a medium or low-pressure turbine part, comprising a reheater, at least one live steam control valve disposed upstream of the high-pressure turbine part, at least one intercept control valve disposed upstream of the medium or low-pressure turbine part and downstream of said reheater, control means having at least one turbine controller for simultaneously acting on said live steam control valve in accordance with a predetermined live steam valve characteristic and acting on said intercept control valve in accordance with a predetermined intercept valve characteristic, said live steam control valve and said intercept control valve having a normal characteristic correlation therebetween determining a correlation of high-pressure and medium or low-pressure steam mass flow, limit detecting means associated with said high-pressure turbine part for responding when a predetermined thermal stress is reached in said high-pressure turbine part, and positioning means controlled by said limit detecting means for changing said normal characteristic correlation and increasing said high-pressure steam mass flow in said steam mass flow correlation.

2. Control device according to claim 1 wherein said limit detecting means includes sensing means for measuring temperature of exhaust steam in vicinity of the outlet of the high-pressure turbine part, and limit signal transmitting means connected to said sensing means for responding when a predetermined temperature limit is exceeded.

3. Control device according to claim 1 wherein said limit detecting means includes first measuring means for determining counter pressure of the high-pressure turbine part, first limit signal transmitting means connected to said first measuring means for issuing an output signal if a predetermined pressure limit is exceeded, second measuring means for determining at least one of the power of the turbine and an operating variable corresponding to the quantity of high-pressure steam, second limit signal transmitting means connected to said second measuring means for issuing an output signal if at least one of the turbine power and said measured operating variable falls below a predetermined valve, and an AND gate having inputs for receiving said output signals.

4. Control device according to claim 3, wherein said first measuring means and said first limit signal transmitting means are combined in the form of a pressure monitor.

5. Control device according to claim 4, including another pressure monitor independent of said first-mentioned pressure monitor, and an OR gate having an input connected to each of said pressure monitors and an output connected to one of said input of said AND gate.

6. Control device according to claim 3, 4 or 5, including a generator driven by the turbine, said second measuring means being in the form of means for measuring electric active power of said generator.

7. Control device according to claim 3, 4 or 5, wherein said second measuring means is in the form of means for measuring the quantity of live steam.

8. Control means according to claim 3, 4 or 5, wherein said second measuring means is in the form of means for determining the wheel space pressure of the high-pressure turbine part.

9. Control device according to claim 3, 4 or 5, wherein said high-pressure turbine part has drum blades, and said second measuring means is in the form of means for determining the pressure upstream of the drum blades of the high-pressure turbine part.

10. Control device according to claim 3, 4 or 5, wherein said second measuring means is in the form of means for determining the stage pressure of a stage of the high-pressure turbine part.

11. Control device according to claim 1, wherein said positioning means changes said normal characteristic correlation by parallel displacement of said intercept valve characteristic.

12. Control device according to claim 1, including at least one first servo piston having a pretensioned spring through which said control means acts on said live steam control valve, and at least one second servo piston having a pretensioned spring through which said control means acts on said intercept control valve, said positioning means including means for increasing the pretension of said spring of said first servo piston relative to the pretension of said spring of said second servo piston.

13. Control device according to claim 12, wherein said positioning means changes said normal characteristic correlation by parallel displacement of said intercept valve characteristic and said relative pretension increasing means exclusively reduces the pretension of said spring of said second servo piston.

14. Control device according to claim 12 or 13, wherein said relative pretension increasing means includes a hydraulic power piston for changing the pretension of said tension spring of said second servo piston.

15. Control device according to claim 14, including a magnetic valve controlling said hydraulic power piston.

* * * * *